US006209263B1

(12) United States Patent
Poirier

(10) Patent No.: US 6,209,263 B1
(45) Date of Patent: Apr. 3, 2001

(54) HURRICANE SHUTTER SYSTEM

(76) Inventor: Ronald R. Poirier, 35 Laurel Oaks Cir., Tequesta, FL (US) 33469

( * ) Notice: Subject to any disclaimer, the term of this patent is extended or adjusted under 35 U.S.C. 154(b) by 0 days.

(21) Appl. No.: 09/489,566

(22) Filed: Jan. 21, 2000

(51) Int. Cl.[7] ..... E05B 65/04
(52) U.S. Cl. ..... 49/61; 49/463
(58) Field of Search ..... 49/50, 57, 61, 49/463, 464; 52/202, 783.12, 783.13, 783.14, 783.15, 784.1, 579, 746.1, 748.1

(56) References Cited

U.S. PATENT DOCUMENTS

| | | | | |
|---|---|---|---|---|
| D. 361,843 | | 8/1995 | Pangborn . | |
| 2,878,536 | | 3/1959 | Becker . | |
| 4,333,271 | | 6/1982 | De Paolo et al. . | |
| 5,228,238 | | 7/1993 | Fenkell . | |
| 5,345,716 | | 9/1994 | Caplan . | |
| 5,457,921 | | 10/1995 | Kostrzecha . | |
| 5,487,244 | * | 1/1996 | Hill | 49/61 X |
| 5,540,018 | * | 7/1996 | Biggers | 49/61 X |
| 5,596,849 | * | 1/1997 | Hill | 49/61 X |
| 5,768,833 | * | 6/1998 | Golen | 49/61 X |
| 5,855,099 | * | 1/1999 | Hoffman | 49/57 X |
| 5,996,292 | * | 12/1999 | Hill et al. | 49/61 X |
| 6,079,168 | * | 6/2000 | Shaver | 49/61 X |

* cited by examiner

*Primary Examiner*—Jerry Redman

(57) ABSTRACT

A hurricane shutter system for installing hurricane shutters fast and easy without the use of a ladder. The hurricane shutter system includes an upper mounting sleeve designed to be screwed to a building. A mounting bracket designed for coupling to the upper mounting sleeve. A cover panel assembly insertable into the mounting sleeve and bolted to the mounting bracket whereby the cover panel assembly is coupled to the building to cover a window of the building.

11 Claims, 3 Drawing Sheets

FIG 1
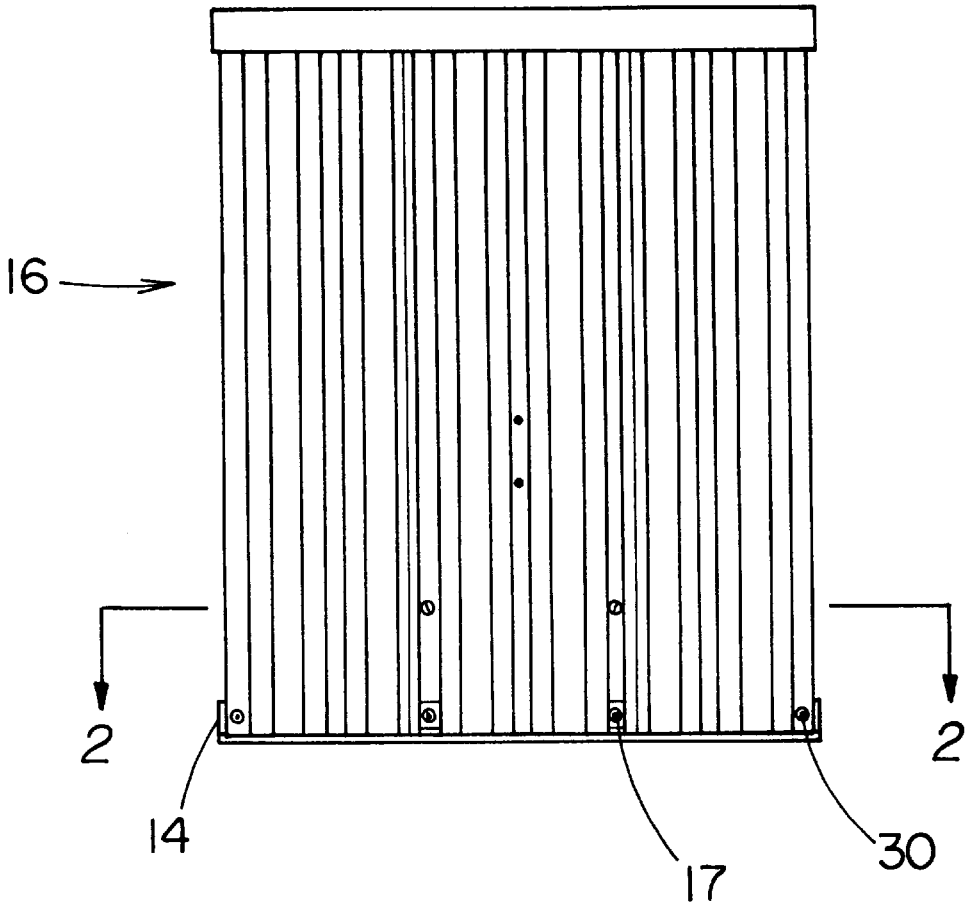
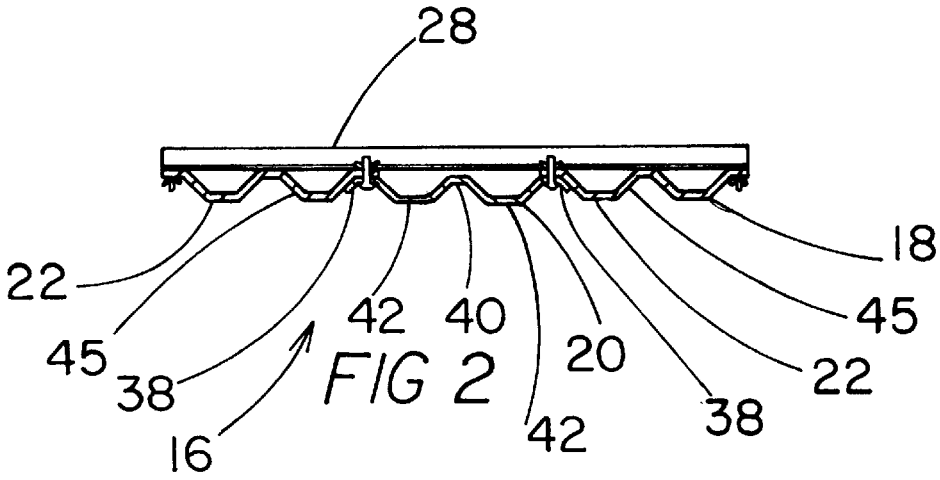
FIG 2

HURRICANE SHUTTER SYSTEM

BACKGROUND OF THE INVENTION

1. Field of the Invention

The present invention relates to shutters and more particularly pertains to a new hurricane shutter system for installing hurricane shutters fast and easy without the use of a ladder.

2. Description of the Prior Art

The use of shutters is known in the prior art. More specifically, shutters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,345,716; U.S. Pat. No. 5,457,921; U.S. Pat. No. 4,333,271; U.S. Pat. No. 5,228,238; U.S. Pat. No. 2,878,536; and U.S. Pat. No. Des. 361,843.

While these devices fulfill their respective, particular objectives and requirements, the aforementioned patents do not disclose a new hurricane shutter system. The inventive device includes an upper mounting sleeve designed to be screwed to a building. A mounting bracket designed for coupling to the upper mounting sleeve. A cover panel assembly insertable into the mounting sleeve and bolted to the mounting bracket whereby the cover panel assembly is coupled to the building to cover a window of the building.

In these respects, the hurricane shutter system according to the present invention substantially departs from the conventional concepts and designs of the prior art, and in so doing provides an apparatus primarily developed for the purpose of installing hurricane shutters fast and easy without the use of a ladder.

SUMMARY OF THE INVENTION

In view of the foregoing disadvantages inherent in the known types of shutters now present in the prior art, the present invention provides a new hurricane shutter system construction wherein the same can be utilized for installing hurricane shutters fast and easy without the use of a ladder.

The general purpose of the present invention, which will be described subsequently in greater detail, is to provide a new hurricane shutter system apparatus and method which has many of the advantages of the shutters mentioned heretofore and many novel features that result in a new hurricane shutter system which is not anticipated, rendered obvious, suggested, or even implied by any of the prior art shutters, either alone or in any combination thereof.

To attain this, the present invention generally comprises an upper mounting sleeve designed to be screwed to a building. A mounting bracket designed for coupling to the upper mounting sleeve. A cover panel assembly insertable into the mounting sleeve and bolted to the mounting bracket whereby the cover panel assembly is coupled to the building to cover a window of the building.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hurricane shutter system apparatus and method which has many of the advantages of the shutters mentioned heretofore and many novel features that result in a new hurricane shutter system which is not anticipated, rendered obvious, suggested, or even implied by any of the prior art shutters, either alone or in any combination thereof.

It is another object of the present invention to provide a new hurricane shutter system that may be easily and efficiently manufactured and marketed.

It is a further object of the present invention to provide a new hurricane shutter system that is of a durable and reliable construction.

An even further object of the present invention is to provide a new hurricane shutter system which is susceptible of a low cost of manufacture with regard to both materials and labor, and which accordingly is then susceptible of low prices of sale to the consuming public, thereby making such hurricane shutter system economically available to the buying public.

Still yet another object of the present invention is to provide a new hurricane shutter system which provides in the apparatuses and methods of the prior art some of the advantages thereof, while simultaneously overcoming some of the disadvantages normally associated therewith.

Still another object of the present invention is to provide a new hurricane shutter system for installing hurricane shutters fast and easy without the use of a ladder.

Yet another object of the present invention is to provide a new hurricane shutter system which includes an upper mounting sleeve designed to be screwed to a building. A mounting bracket designed for coupling to the upper mounting sleeve. A cover panel assembly insertable into the mounting sleeve and bolted to the mounting bracket whereby the cover panel assembly is coupled to the building to cover a window of the building.

Still yet another object of the present invention is to provide a new hurricane shutter system that can be installed without the use of a ladder.

Even still another object of the present invention is to provide a new hurricane shutter system that can be installed quickly and easily in hard to reach locations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front view of a new hurricane shutter system according to the present invention.

FIG. 2 is a end view of the present invention.

DESCRIPTION OF THE PREFERRED EMBODIMENT

Figure 3:
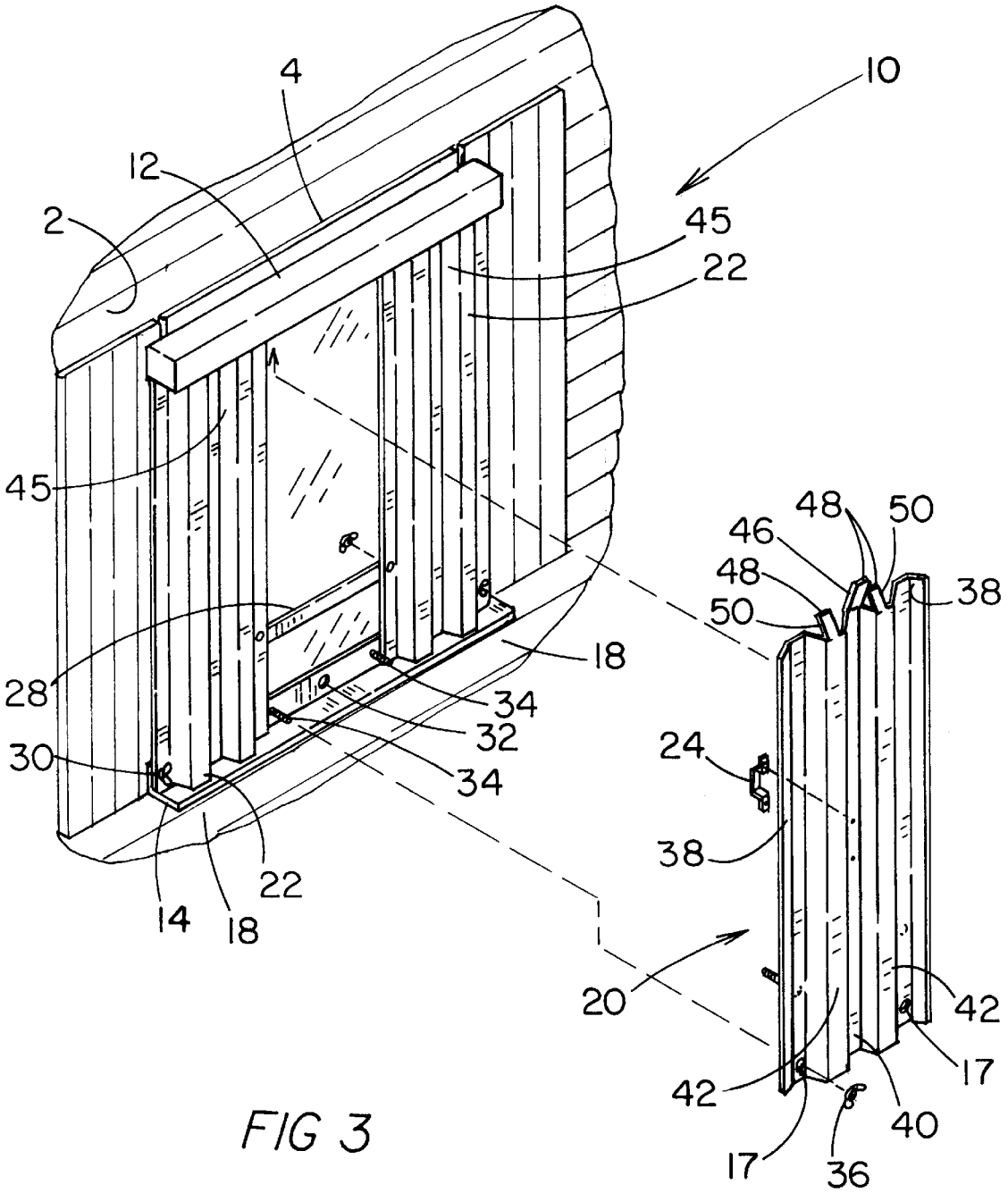
FIG. 3 is a side perspective view of the present invention.
Figure 4:
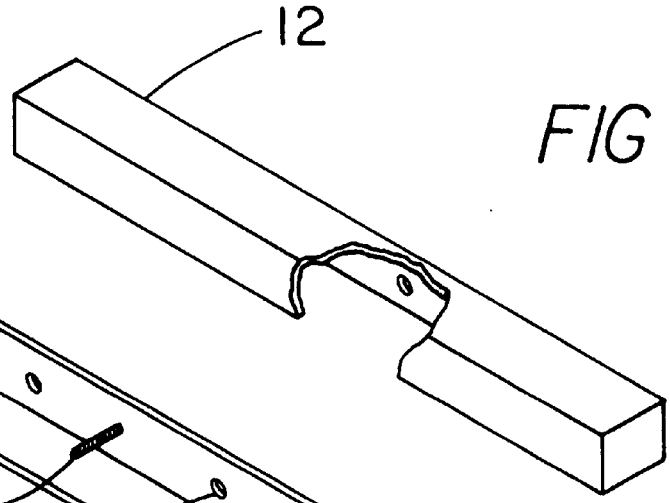
FIG. 4 is a top view of the sleeve of the present invention.
Figure 5:
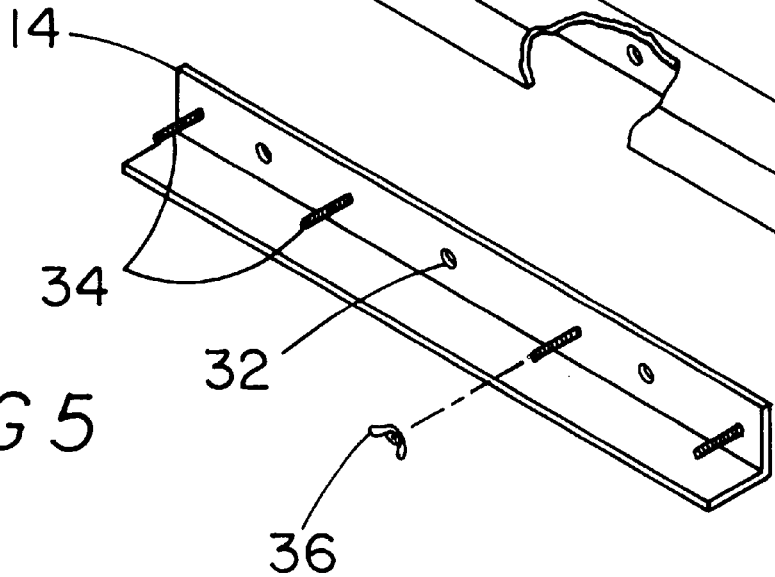
FIG. 5 is a top perspective view of the bottom bracket of the present invention.

With reference now to the drawings, and in particular to FIGS. 1 through 5 thereof, a new hurricane shutter system embodying the principles and concepts of the present invention and generally designated by the reference numeral 10 will be described.

As best illustrated in FIGS. 1 through 5, the hurricane shutter system 10 generally includes an upper mounting sleeve 12 designed to be screwed to a building 2. A mounting bracket 14 is designed to be screwed to the building in spaced relationship to the upper mounting sleeve 12. A cover panel assembly 16 is insertable into the mounting sleeve 12 and bolted to the mounting bracket 14 whereby the cover panel assembly 16 is attached to the building 2 to cover a window 4 of the building 2.

The cover panel assembly 16 including a plurality of cover panels 18, each cover panel 18 is couplable to an adjacently positioned cover panel 18 for forming the cover panel assembly 16. The plurality of cover panels 18 including a central cover panel 20 and a pair of outer panels 22. The cover panel assembly 16 includes a handle 24 for facilitating manipulation of the cover panel assembly 26 when inserting the cover assembly 26 into the mounting sleeve 12 and bolting the cover panel assembly 16 to the mounting bracket 14. There is a brace 28 bolted to the cover panel assembly 16 for maximizing stiffness of the cover panel assembly 16.

The mounting bracket 14 includes a plurality of building mounting holes 32. The cover panel assembly 16 including a plurality of bracket mounting holes 30 for mounting the cover panel assembly to the mounting bracket 14. A plurality of bolts 34 extend from the mounting bracket 14 for insertion through the aligned panel mounting holes 30. A plurality of fasteners 36 are provided, each fastener 36 being for coupling to a respective one of the bolts 34 for coupling the cover panels 18 to the mounting bracket 14. The bolts 34 are fixed relative to the bracket 14 to facilitate fastening of the fasteners to the bolts.

The central cover panel 20 includes a pair of coplanar outer portions 38 and a planar central portion 40 with the central portion 40 being coplanar with the outer portions 38. The central cover panel 20 includes a pair of coplanar medial portions 42 that are located in a plane parallel to a plane in which the central portion 20 and the outer portions 22 lie. Each of the medial portions 42 is positioned between the central portion 20 and a respective one of the outer portions 22. A plurality of cross-portions 44 integrally connect the central 20, medial 42, and outer portions 22. The central cover panel 20 also includes a number of cutouts 17 positioned to align with the bolts 34 for facilitating positioning of the central cover panel 20 against the outer panels 22.

A central tab 46 extends outwardly from a top edge 48 of the central portion 20. The central tab 46 is angled such that a top edge 48 of the central tab 46 extends towards the plane in which the medial portions lie 42. A pair of medial tabs 50, each medial tab 50 extending outwardly from a top edge 48 of a respective one of the medial portions 42, each of the medial tabs 50 is angled such that a top edge 48 of each medial tab 50 extends towards the plane in which the central portion 20 lies.

In use, the hurricane shutter system is easily installed using multiple panels comprising the cover panel assembly. The user first installs and tightens the end panels to the mounting sleeve and the mounting bracket. Then the user installs the central panel, slides the brace into position and tightens the brace to the central panel with two wing nut fasteners. This system eliminates the use of a ladder when installing hurricane shutters and allows a user to quickly fasten shutters to the exterior of the building.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hurricane shutter system comprising:

an upper mounting sleeve adapted for coupling to a building;

a mounting bracket adapted for coupling to a building in spaced relationship to said upper mounting sleeve;

a cover panel assembly insertable into said mounting sleeve and couplable to said mounting bracket whereby said cover panel assembly is coupled to said building to cover a window of the building; and said cover assembly includes a plurality of angled tabs extending upwardly from a top edge of said cover assembly for facilitating insertion and retention of said cover assembly into said mounting sleeve.

2. The hurricane shutter system of claim 1, further comprising:

said cover panel assembly including a plurality of cover panels, each cover panel being couplable to said mounting bracket and said mounting sleeve, each cover panel further being couplable to an adjacently positioned cover panel for forming said cover panel assembly.

3. The hurricane shutter system of claim 2, further comprising:

each cover panel being corrugated.

4. The hurricane shutter system of claim 2, further comprising:

said plurality of cover panels including a central cover panel and a pair of outer panels.

5. The hurricane shutter system of claim 4, further comprising:

said central cover panel includes a pair of coplanar outer portions, a planar central portion, said central portion being coplanar with said outer portions;

said central cover panel includes a pair of coplanar medial portions, said medial portions being located in a plane parallel to a plane in which said central portion and said outer portions lie, each of said medial portions being positioned between said central portion and a respective one of said outer portions; and a plurality of cross-portions integrally connecting said central, medial, and outer portions.

6. The hurricane shutter system of claim 5, further comprising:

a central tab extending outwardly from a top edge of said central portion, said central tab being angled such that a top edge of said central tab extends towards the plane in which the medial portions lie; and a pair of medial tabs, each medial tab extending outwardly from a top edge of a respective one of said medial portions, each of said medial tabs being angled such that a top edge of each medial tab extends towards the plane in which the central portion lies.

7. The hurricane shutter system of claim 1, further comprising:

said cover panel assembly including a handle for facilitating manipulation of said cover panel assembly when inserting said cover assembly into said mounting sleeve and coupling said cover panel assembly to said mounting bracket.

8. The hurricane shutter system of claim 1, further comprising:

a brace for coupling to said cover panel assembly for maximizing stiffness of said cover assembly.

9. The hurricane shutter system of claim 1, further comprising:

said mounting bracket including a plurality of building mounting holes for facilitating coupling of said mounting bracket to a building;

a plurality of bolts extending from said mounting bracket;

said cover panel assembly including a plurality of bracket mounting holes, said bracket mounting holes being alignable with said bolts when said cover panel assembly is inserted into said mounting sleeve; and a plurality of fasteners, each fastener being for coupling to a respective one of said bolts for coupling said cover panel assembly to said mounting bracket.

10. A hurricane shutter system comprising:

an upper mounting sleeve adapted for coupling to a building;

a mounting bracket adapted for coupling to a building in spaced relationship to said upper mounting sleeve;

a cover panel assembly insertable into said mounting sleeve and couplable to said mounting bracket whereby said cover panel assembly is coupled to said building to cover a window of the building;

said cover panel assembly including a plurality of cover panels, each cover panel being couplable to said mounting bracket and said mounting sleeve, each cover panel further being couplable to an adjacently positioned cover panel for forming said cover panel assembly;

said plurality of cover panels including a central cover panel and a pair of outer panels;

said central cover panel includes a pair of coplanar outer portions, a planar central portion, said central portion being coplanar with said outer portions;

said central cover panel includes a pair of coplanar medial portions, said medial portions being located in a plane parallel to a plane in which said central portion and said outer portions lie, each of said medial portions being positioned between said central portion and a respective one of said outer portions;

a plurality of cross-portions integrally connecting said central, medial, and outer portions;

a central tab extending outwardly from a top edge of said central portion, said central tab being angled such that a top edge of said central tab extends towards the plane in which the medial portions lie; and a pair of medial tabs, each medial tab extending outwardly from a top edge of a respective one of said medial portions, each of said medial tabs being angled such that a top edge of each medial tab extends towards the plane in which the central portion lies.

11. A hurricane shutter system comprising:

an upper mounting sleeve adapted for coupling to a building;

a mounting bracket adapted for coupling to a building in spaced relationship to said upper mounting sleeve;

a cover panel assembly having a plurality of cover panels, each cover panel being insertable into said mounting sleeve and couplable to said mounting bracket whereby said cover panel assembly is coupled to said building to cover a window of the building;

each cover panel being couplable to an adjacently positioned cover panel for forming said cover panel assembly;

each cover panel being corrugated;

said plurality of cover panels including a central cover panel and a pair of outer panels;

said cover panel assembly including a handle coupled to at least one of said cover panels for facilitating manipulation of said cover panel when inserting said cover panel into said mounting sleeve and coupling said cover panel assembly to said mounting bracket and to adjacently positioned cover panels;

a brace for coupling to said cover panel assembly for maximizing stiffness of said cover assembly;

said mounting bracket including a plurality of building mounting holes for facilitating coupling of said mounting bracket to a building;

a plurality of bolts extending from said mounting bracket;

said cover panel assembly including a plurality of bracket mounting holes, said bracket mounting holes being alignable with said bolts when said cover panel assembly is inserted into said mounting sleeve;

a plurality of fasteners, each fastener being for coupling to a respective one of said bolts for coupling said cover panel assembly to said mounting bracket;

said central cover panel includes a pair of coplanar outer portions, a planar central portion, said central portion being coplanar with said outer portions;

said central cover panel includes a pair of coplanar medial portions, said medial portions being located in a plane parallel to a plane in which said central portion and said outer portions lie, each of said medial portions being positioned between said central portion and a respective one of said outer portions; and a plurality of cross-portions integrally connecting said central, medial, and outer portions;

a central tab extending outwardly from a top edge of said central portion, said central tab being angled such that a top edge of said central tab extends towards the plane in which the medial portions lie; and a pair of medial tabs, each medial tab extending outwardly from a top edge of a respective one of said medial portions, each of said medial tabs being angled such that a top edge of each medial tab extends towards the plane in which the central portion lies.

* * * * *